United States Patent [19]

Bürklin

[11] Patent Number: 5,021,150

[45] Date of Patent: Jun. 4, 1991

[54] SIEVE DRUM FOR SIEVING OUT WASTE OR THE LIKE

[76] Inventor: Werner Bürklin, Sonnhaldenstrasse 8, CH-8280, Kreuzling en, Fed. Rep. of Germany

[21] Appl. No.: 466,212

[22] Filed: Jan. 17, 1990

[30] Foreign Application Priority Data

Jan. 18, 1989 [DE] Fed. Rep. of Germany ..... 3901351

[51] Int. Cl.[5] ..... B07B 1/22; B07B 1/46

[52] U.S. Cl. ..... 209/245; 209/290; 209/294; 209/410

[58] Field of Search ..... 209/288, 284, 289, 290, 209/293, 294, 297, 298, 683, 930, 251, 252, 253, 404, 406, 413, 410, 411, 416, 247, 245

[56] References Cited

U.S. PATENT DOCUMENTS

| | | | |
|---|---|---|---|
| 209,730 | 11/1878 | Vellines | 209/411 X |
| 393,944 | 12/1888 | Vivarttas | 209/411 X |
| 1,563,173 | 11/1925 | Doerres | 209/288 X |
| 4,226,271 | 10/1980 | Coleman | 209/288 X |
| 4,533,054 | 8/1985 | Sommer et al. | 209/930 X |
| 4,585,354 | 4/1986 | Thesenfitz | 209/290 X |
| 4,857,180 | 8/1989 | Eriksson | 209/297 X |

FOREIGN PATENT DOCUMENTS

| | | | |
|---|---|---|---|
| 82815 | 6/1983 | European Pat. Off. | 209/288 |

*Primary Examiner*—Donald T. Hajec
*Attorney, Agent, or Firm*—Bachman & LaPointe

[57] ABSTRACT

A sieve drum (1) for sieving out waste or the like, in particular domestic refuse, having an intake associated with an open end of the drum is mounted pivotably at an angle or inclination (w) approximately at the middle of its length (n) and is to have perforations (14, 15) of different sizes. It has also been found advantageous for the perforations (14, 15) to be of cross-sections which decrease in a direction of the sieve drum (1) from one end thereof.

18 Claims, 1 Drawing Sheet

Fig. 1
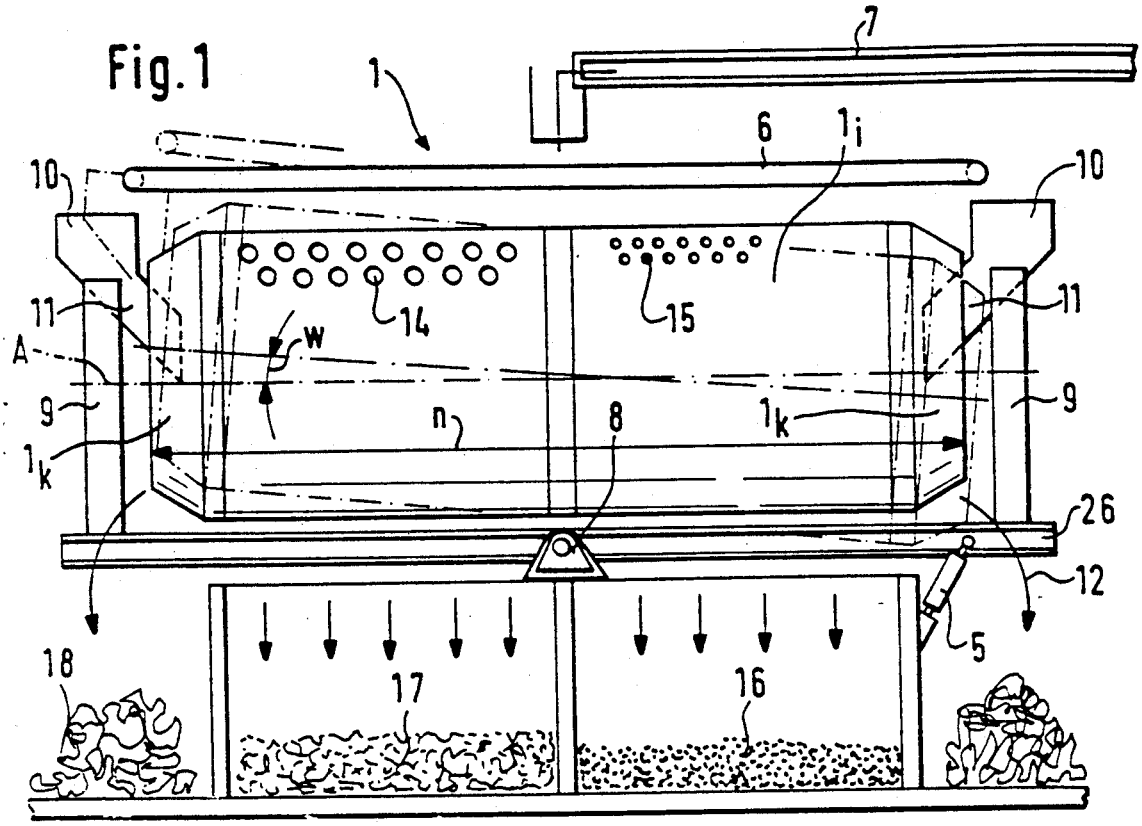
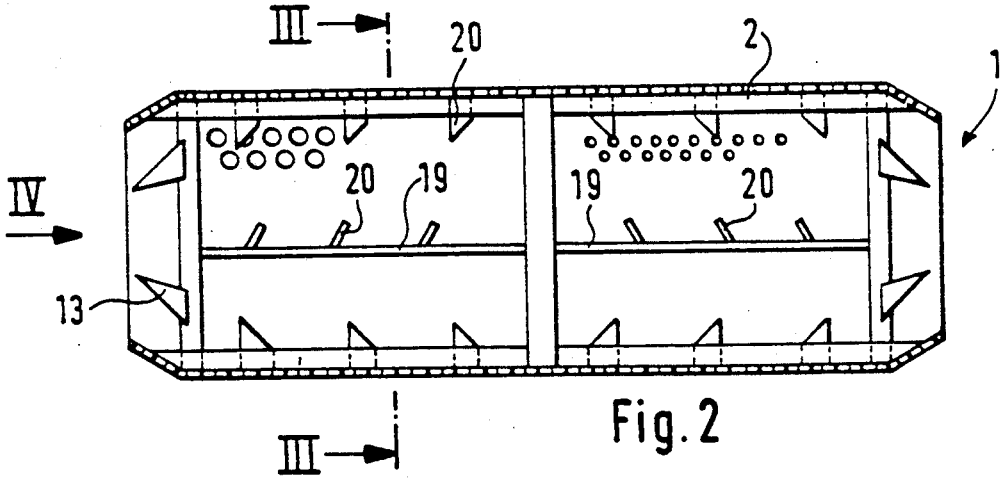
Fig. 2
Fig. 3
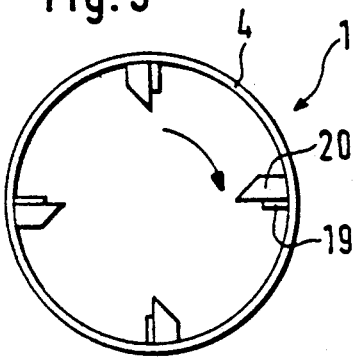
Fig. 4
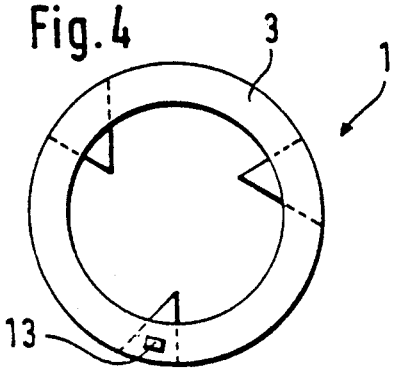

SIEVE DRUM FOR SIEVING OUT WASTE OR THE LIKE

DESCRIPTION

The invention relates to a sieve drum as set forth in the classifying portion of claim 1. The aim of the invention is simplification of such sieve drums and inexpensive manufacture and operation thereof.

That aim is achieved by the characterising portion of claim 1. Additional improvements are set forth in the subsidiary claims.

Further advantages, features and details will be apparent from the following description of preferred embodiments and with reference to the drawing in which:

FIG. 1 is a side view of an apparatus according to the invention,

FIG. 2 is a view in longitudinal section through a part of FIG. 1,

FIG. 3 is a view in section taken along line III—III in FIG. 2, and

FIG. 4 is a front view indicated by the arrow IV in FIG. 2.

A sieve or screening drum 1 of a length n is mounted centrally on an inclination adjusting drive 8 in a rocker-like manner which is carried by a base support structure 26, in such a way that the drum can be transferred from the horizontal position shown in FIG. 1 into a right-hand inclined position as illustrated in broken lines, and in a corresponding fashion into a left-hand inclined position. Piston-cylinder units 5 are provided for that purpose.

The sieve drum 1 is supplied with raw material by way of a distributor conveyor belt 6 which is disposed thereabove and which receives that material from a feed conveyor member 7 which provides a central delivery. Vertical supports 9 of the support base structure 26 each hold an intake hopper 10 of a feed chute 11, which respectively project into the open left-hand and right-hand conical ends $1_k$ of the sieve drum 1.

The intake hoppers 10 are disposed above the drum axis A, and their closed intake chutes 11 project into the interior $1_i$ of the drum; the delivery material can be introduced into the drum 1 over the horizontal axis A of the drum 1. The delivery material, after passing through the drum, is discharged at the other end by means of installed discharge blades 13 (see FIG. 4).

Large perforated sieves or screens 14 may be releasably mounted on the sieve drum 1 on the left-hand half thereof, while small perforated sieves or screens 15 may be releasably mounted on the right-hand half of the drum. By virtue of the central pivotal mounting, material which is supplied to the delivery hopper 10, or the finer sieve fraction of the material, passes into a receiving chamber 16 which is disposed beneath the sieve drum 1, while the next coarser material passes through the perforations 14 into a left-hand receiving chamber 17; the oversize pieces are discharged by way of the above-described discharge blades 13 and drop into an outside box as indicated at 18.

By adjusting the angle of inclination w of the drum, it is possible for the transit time of the material which is to be sieved out to be reduced or increased. Due to the angle of inclination w, material which is fed to the drum on the left-hand side in FIG. 1 first encounters the coarse-mesh side of the drum with the coarse perforations 14 and flows over the perforations 15 to the discharge 12 (arrow shown in FIG. 1). In that way, a fine component which is contained in the coarse fraction is sieved off there (at 14) and is not previously discharged through the perforations 15, as in the opposite position of inclination of the drum.

The sieve drum 1 has longitudinally extending continuous metal plate blades 19 (see FIG. 3) which constantly lift the material and fling it on to the respective oppositely disposed sieve surface. That procedure can again be adapted to the desired requirements by setting the drum for fast or slow rotation.

In addition, mounted on the metal plate blades 19 are transverse transporting blades 20 which transport the material back and keep it longer in the drum portion (which is adapted by virtue of the inclination w of the sieve drum 1).

The transporting blades 20 are of a particular configuration which for example tear open full refuse sacks or paper bags or the like, by virtue of the metal plate blades 19 and the inclined or acutely associated transporting blades 20, the content thereof being emptied.

By choosing a suitable speed of rotation it is possible for example to selectively provide for better sieving out of organic domestic refuse.

For the operation for sorting out domestic refuse, metal plates with the same sieve perforations or mesh size can be selectively used at the locations 14 and 15. By adjusting the angle of inclination w, the quality of the sieving-out action and the output of the apparatus can be better matched, that is to say the delivery material can be better retained in the sieve drum 1 to provide an improved sieving effect.

I claim:

1. A sieve for sieving out waste material comprises an elongated sieve drum pivotably mounted on a base support structure about a pivot point, said elongated sieve drum having an elongated axis A, a length M, a radial plane which passes through the pivot point and a pair of openings at each end of the drum; intake hoppers associated with said openings for communicating waste material there through; and a feed conveyor member associated with said intake hoppers, said feed conveyor member being selectively moved in two conveying directions.

2. A sieve drum as set forth in claim 1 characterized in that the sieve drum is provided with perforations (14, 15) of different sizes.

3. A sieve drum as set forth in claim 2 characterized in that the perforations decrease in cross-section along the longitudinal extent of the sieve drum (1).

4. A sieve drum as set forth in claim 1 characterised in that an approximately central delivery means (7) for the waste is associated with the feed conveyor member (6).

5. A sieve drum as set forth in claim 1 characterised in that metal plate blades (19) are disposed in the interior ($1_i$) of the drum.

6. A sieve drum as set forth in claim 5 characterised in that the metal plate blades (19) project radially into the interior ($1_i$).

7. A sieve drum as set forth in claim 6 characterised in that transporting blades (20) are associated with the metal plate blades (19).

8. A sieve drum as set forth in claim 7 characterised in that the transporting blades (20) have edges which are inclined towards the axis (A) of the drum.

9. A sieve drum as set forth in claim 8 characterised in that the transporting blades (20) are inclined with respect to the axis (A) of the drum.

10. A sieve drum as set forth in claim 1 characterized in that the radial plane of the sieve drum (1) is a plane of symmetry in relation to the blades (19, 20) thereof.

11. A sieve drum as set forth in claim 10 characterized in that different sized perforations are disposed on either side of the radial plane of the sieve drum (1).

12. A sieve drum as set forth in claim 1 characterised in that discharge blades (13) are provided at the ends of the sieve drum (1) and project into the interior ($1_i$) thereof.

13. A sieve drum as set forth in claim 1 characterised in that it is provided at both ends with a respective conical discharge end ($1_k$).

14. A sieve drum as set forth in claim 1 characterised in that the sieve drum is rotatably mounted on a base support structure (26) which is rotatably mounted at the pivot mounting (8).

15. A sieve drum as set forth in claim 14 characterized in that the base support structure (26) is pivotably mounted in a rocker-like manner and is adjustable with respect to its angle of inclination (w) by means of at least one force storage means (5) of variable length.

16. A sieve drum as set forth in claim 15 characterized in that the sieve drum is arranged above a plurality of receiving chambers (16 through 18) for receiving the sieve fractions.

17. A sieve drum as set forth in claim 16 characterised in that the number of chambers (16 through 18) corresponds to the number of sieve fractions.

18. A sieve drum as set forth in claim 17 characterized by two chambers which are disposed on each of the sides of the radial plane.

* * * * *